US006515735B2

(12) United States Patent
Takoh

(10) Patent No.: US 6,515,735 B2
(45) Date of Patent: Feb. 4, 2003

(54) STACKER APPARATUS AND PRINTING APPARATUS

(75) Inventor: Hidehiko Takoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/119,684

(22) Filed: Apr. 11, 2002

(65) Prior Publication Data

US 2002/0118351 A1 Aug. 29, 2002

Related U.S. Application Data

(63) Continuation of application No. PCT/JP99/06212, filed on Nov. 8, 1999.

(51) Int. Cl.[7] ..... G03B 27/58; B65H 29/00; B65H 39/10; B65H 3/44

(52) U.S. Cl. ..... 355/72; 271/278; 271/279; 271/287; 271/9.01

(58) Field of Search ..... 355/72; 399/23, 399/393; 271/3.13, 3.14, 9.01, 9.11, 298, 278, 279, 287, 288, 289, 153

(56) References Cited

U.S. PATENT DOCUMENTS 4,569,586 A 2/1986 Koyama

FOREIGN PATENT DOCUMENTS

| | | |
|---|---|---|
| JP | 59-190129 | 10/1984 |
| JP | 63-106267 | 5/1988 |
| JP | 3-249034 | 11/1991 |
| JP | 6-286933 | 10/1994 |
| JP | 11-228015 | 8/1999 |

*Primary Examiner*—Russell Adams
*Assistant Examiner*—Peter B. Kim
(74) *Attorney, Agent, or Firm*—Armstrong, Westerman & Hattori, LLP

(57) ABSTRACT

A stacker apparatus is disclosed which includes a plurality of trays for receiving sheet-like media discharged from two or more medium exits. Between two upper and lower medium exits (4C, 4D) included in the two or more medium exits (4A to 4F), a tray holder (8C) on which the upper side tray (7C) for receiving sheet-like media (20) discharged from the upper side medium exit (4C) of the two upper and lower medium exits (4C, 4D) in a stacked state can be removably and securely held is disposed. The tray holder (8C) is selectively changed over to one of a first state wherein the tray holder (8C) securely holds the upper side tray (7C) when the upper side tray (7C) is mounted thereon and a second state wherein the tray holder (8C) releases the upper side tray (7C) and operates integrally with the lower side tray (7D) provided for receiving the sheet-like media (20) discharged from the lower side medium exit (4D) of the two upper and lower medium exits (4C, 4D) in a stacked state to function as part of a tray for receiving sheet-like media (20) from the upper side medium exit (4C) in a stacked state together with the lower side tray (7D).

21 Claims, 8 Drawing Sheets

STACKER APPARATUS AND PRINTING APPARATUS

This application is a continuation of international application PCT/JP99/06212 filed on Nov. 8, 1999.

1. Technical Field

This invention relates to a stacker apparatus suitably provided at an exit of an apparatus which sorts sheet-type media into a plurality of divisions in upward and downward directions and a printing apparatus having a function of stacking sheet-type media such as printing paper sheets in a plurality of stages.

2. Background Art

Heretofore, a printing apparatus of a printer, a copying machine or the like has in most cases been used solely by itself or used in a state wherein it is connected to a particular terminal. In recent years, however, the opportunity that a printing apparatus is used in a state where it is connected to a plurality of personal computers, office computers or the like by a LAN has been and is increasing. According to such a method of use as just described, there is an advantage that one printing apparatus can be shared to improve the operating ratio of the printing apparatus and save the installation space.

However, if the printing apparatus has only one exit for printed matters, then printed paper sheets of different terminals become mixed. Where the total amount of printed paper sheets is small, the burden of sorting work is light. However, as the total amount increases, the burden of sorting work increases, and this may possibly lower the efficiency in operation. Accordingly, it is convenient if the printing apparatus has exits for different terminals or for different operation contents and sorts printed paper sheets thereof suitably into corresponding exits.

Thus, recently where a printing apparatus is shared using a LAN as described above, a printing apparatus 100 which has a plurality of exits 106A to 106F as shown in FIG. 9 is used. In this printing apparatus 100, data inputted from different terminals are processed by a control station 102, and a designated cassette or a cassette for accommodating paper sheets corresponding to a printing area is selected from between paper feeding cassettes 103A, 103B. Then, a paper sheet is supplied from the selected paper feeding cassette to a print unit station 104, and the paper is printed by the print unit station 104 and the print is fixed by a fixing station 105, whereafter the printed matter is discharged to a suitable one of the exits 106A to 106F in a stacker station 101.

As an arrangement of the exits 106A to 106F, various arrangements such as an arrangement in upward and downward directions and an arrangement in a horizontal direction are possible. Normally, however, the exits 106A to 106F are arranged in upward and downward directions as shown in FIG. 9 from the point of view of reduction of the space or miniaturization of the apparatus. Further, trays 107A to 107F are provided for the exits 106A to 106F, respectively, and printed paper sheets are sorted for individual sorting destinations and stacked onto the trays 107A to 107F in the stacker station 101.

In this instance, the trays 107A to 107F can be allocated to the different terminals. For example, if it is assumed that personal computers 120, 121, an office computer 122 and a global server 123 as terminals are connected to one another by a LAN 124, then also the trays 107A to 107F are allocated to the individual terminals.

For example, the trays 107A, 107B are allocated to the personal computer 120, the trays 107C, 107D are allocated to the personal computer 121, the tray 107E is allocated to the office computer 122, and the tray 107F is allocated to the global server 123. Further, to the personal computers 120, 121 from which a great amount of prints is originated, the trays 107A, 107B and the trays 107C, 107D can be allocated to different operation contents.

In this manner, with the printing apparatus 100 having a plurality of exits 106A to 106F (trays 107A to 107F) described above, by allocating the trays 107A to 107F to individually different operations or terminals, the single printing apparatus can be used efficiently without causing the printed matters to be mixed.

However, also the printing apparatus 100 in this instance is not universal for all operation forms.

In particular, while there is an operation which involves a small amount of prints but involves a great number of sorting divisions, also another operation which involves a small number of sorting divisions but involves a great amount of prints for one division is present. In an operation which involves a great number of sorting divisions, the convenience is improved as the number of exits (number of trays) increases, but in another operation which involves a great amount of prints for one division, the convenience is improved as the stacking capacity of each tray increases. When the diversity of needs in recent years is taken into consideration, it is desirable to satisfy both of the demands. However, with the printing apparatus 100 described above, since both of the number of exits (number of trays) and the stacking capacity of the trays are fixed, it is difficult to satisfy such diversified needs as described above.

It is to be noted that, as a countermeasure for satisfying both of the demands described above, it is a possible idea to make the number of exits (number of trays) and the stacking capacity of the trays variable or to make both of the number of exits (number of trays) and the stacking capacity great. However, in the former case, the mechanism becomes complicated, resulting in increase of the cost, and in the latter case, the size of the apparatus becomes very great. Therefore, they are not sufficient as means for solving the subjects described above.

While the subjects of the conventional printing apparatus are described above, the subjects described above are not limited to such printing apparatus of a printer, a copying machine and so forth as described above, but are subjects common to general equipments which include a stacker apparatus which sorts comparatively thin articles such as, for example, a sorting machine (sorter) for mails or magazines and has a plurality of exits in upward and downward directions so that sorted articles are successively stacked.

The present invention has been made in view of such subjects as described above, and it is an object of the present invention to provide a stacker apparatus wherein the number of trays or the stacking capacity of trays can be set as required without inviting increase of the cost or increase in size of the apparatus.

It is another object of the present invention to provide a printing apparatus wherein the number of trays or the stacking capacity of a stacking station can be set as required without inviting increase of the cost or increase in size of the apparatus.

DISCLOSURE OF INVENTION

In order to attain the object described above, according to the present invention, a stacker apparatus which includes a plurality of trays for receiving sheet-like media discharged from two or more medium exits disposed in upward and downward directions separately and individually for the medium exits in a stacked state is characterized in that, between two upper and lower medium exits included in the two or more medium exits, a tray holder on which the upper side tray for receiving the sheet-like media discharged from the upper side medium exit of the two upper and lower medium exits in a stacked state can be removably and securely held is disposed, and that the tray holder is selectively changed over to one of a first state wherein the tray holder securely holds the upper side tray when the upper side tray is mounted thereon and a second state wherein the tray holder releases the upper side tray and operates integrally with the lower side tray provided for receiving the sheet-like media discharged from the lower side medium exit of the two upper and lower medium exits in a stacked state to function as part of a tray for receiving the sheet-like media from the upper side medium exit in a stacked state together with the lower side tray.

With the stacker apparatus, when a greater number of divisions are required, this requirement can be satisfied by mounting the upper side tray into the tray holder and using both of the upper side tray and the lower side tray as a discharging destination. However, when a high stacking capacity of a tray is required, this requirement can be satisfied by removing the upper side tray from the tray holder and integrating the tray holder with the lower side tray so that it functions as part of a tray for stacking sheet-type media from the upper side medium exit together with the lower side tray. Consequently, there is an advantage that the number of trays or the stacking capacity of the trays can be set as required without inviting increase of the cost or increase of the size of the apparatus.

Preferably, the tray holder is supported for pivotal motion around an axis extending horizontally and perpendicularly to the discharging direction of the sheet-like media on a body of the stacker apparatus such that the tray holder is changed over between the first state and the second state by pivotal motion of the tray holder around the axis. With the stacker apparatus, the number of trays can be increased readily or the stacking capacity of a tray can be increased readily.

The stacker apparatus may be configured such that a recess for fitting with the lower side tray when the tray holder is in the second state is formed on the tray holder such that, in a state wherein the lower side tray is fitted in the recess, an inner face of the lower side tray adjacent the medium exits and an outer face of the tray holder adjacent the side trays are in register with each other and the outer face of the tray holder adjacent the side trays functions, together with the inner face of the lower side tray adjacent the medium exits, as a guide for guiding a sheet-like medium from the upper side medium exit and arranging the position of an end portion of the sheet-like medium adjacent the medium exits. With the stacker apparatus, there is an advantage that sheet-type media discharged from the upper side medium exit can be stacked in a good order onto the lower side tray.

The stacker apparatus may be configured such that the tray holder in the second state closes up the lower side medium exit and the stacker apparatus further comprises a detection element for detecting that the tray holder is in the second state, and that the detection element outputs, when it is detected that the tray holder is in the second state, a detection signal as an instruction signal for urging to stop the discharging of a sheet-like medium from the lower side medium exit and discharge a sheet-like medium from the upper side medium exit. With the stacker apparatus, there is an advantage that such a situation that a sheet-type medium is fed into the closed up lower side medium exit to cause paper jamming can be prevented.

A tray full sensor mounted on the tray holder for detecting a fully stacked state of the sheet-like media on the lower side tray when the tray holder is in the first state may be used as the detection element.

In this instance, preferably the tray full sensor includes a lever member mounted on a lower face of the tray holder in the first state above the lower side tray and supported at one end side thereof for pivotal motion on the tray holder, and a sensor element for detecting the other end side of the lever member, and, when the tray holder is in the first state, if the sheet-like media stacked in the lower side tray are not in a fully stacked state, then the other end side of the lever member is positioned spaced away from the sensor element by the weight of the lever member itself, but if the sheet-like media are stacked in a fully stacked state in the lower side tray, then the other end side of the lever member is pushed up to the sensor element by the sheet-like media and detected by the sensor element, whereby the tray full sensor detects the fully stacked state of the sheet-like media. Further preferably, when the tray holder is in the second state, upon the pivotal motion of the tray holder from the first state to the second state, the other end side of the lever member is moved to the position of the sensor element by the weight of the lever member itself and detected by the sensor element, whereby the tray full sensor detects that the tray holder is in the second position. With the stacker apparatus, the fully stacked state of sheet-type media received in a stacked state on the lower side tray and that the tray holder is in the second state described above can be detected by the single tray full sensor, and there is an advantage that the number of parts can be reduced.

In this instance, further preferably the detection signal outputted from the tray full sensor as a result of detection of the other end side of the lever member after discharging of a sheet-like medium from the lower side medium exit is detected is used as an instruction signal for urging to stop the discharging of a sheet-like medium from the lower side medium exit and issue a tray full alarm, and the detection signal outputted from the tray full sensor as a result of detection of the other end side of the lever member although discharging of a sheet-like medium from the lower side medium exit is not detected is used as an instruction signal for urging to stop the discharging of a sheet-like medium from the lower side medium exit and discharge a sheet-like medium from the upper side medium exit. Through the combination with the detection of discharging of a sheet-type medium from the lower side medium exit in this manner, there is an advantage that it can be discriminated readily and with certainty whether the tray full sensor detects a fully stacked state of sheet-type media received in a stacked state on the lower side tray or detects that the tray holder is in the second state described above.

Further, the sensor element may be formed from an optical sensor which detects the other end side of the lever member through a light intercepting movement of the other end side of the lever member. With the stacker apparatus, there is an advantage that a pivotal movement of the tray holder to the second state can be detected with certainty with a simple configuration.

Furthermore, the distance between the upper side tray and the lower side tray and the installation angle of each of the trays may be set so that, before a trailing end of a sheet-like medium discharged from the upper side medium exit is released from discharge rollers at the upper side medium exit, a leading end of the sheet-like medium arrives at the lower side tray. With the stacker apparatus, there is an advantage that the possibility that, when the stacking capacity is increased, a sheet-type medium discharged from the upper side medium exit may be caught or bent when it drops onto the lower side tray can be reduced.

Meanwhile, in order to attain the object described above, according to the present invention, a printing apparatus is characterized in that it comprises a printing station for printing a sheet-like medium and discharging the sheet-like medium from one of two or more medium exits disposed in upward and downward directions, and a stacker station including a plurality of trays for receiving sheet-like media discharged from the two or more medium exits of the printing station separately and individually for the medium exits in a stacked state, that, in the stacker station, between two upper and lower medium exits included in the two or more medium exits, a tray holder on which the upper side tray for receiving the sheet-like media discharged from the upper side medium exit of the two upper and lower medium exits in a stacked state can be removably and securely held is disposed, and that the tray holder is selectively changed over to one of a first state wherein the tray holder securely holds the upper side tray when the upper side tray is mounted thereon and a second state wherein the tray holder releases the upper side tray and operates integrally with the lower side tray provided for receiving the sheet-like media discharged from the lower side medium exit of the two upper and lower medium exits in a stacked state to function as part of a tray for receiving the sheet-like media from the upper side medium exit in a stacked state together with the lower side tray.

With the printing apparatus, when a greater number of divisions are required, this requirement can be satisfied by mounting the upper side tray into the tray holder and using both of the upper side tray and the lower side tray as a discharging destination. However, when a high stacking capacity of a tray is required, this requirement can be satisfied by removing the upper side tray from the tray holder and integrating the tray holder with the lower side tray so that it functions as part of a tray for stacking sheet-type media from the upper side medium exit together with the lower side tray. Consequently, there is an advantage that the number of trays or the stacking capacity of the trays of the stacker station can be set as required without inviting increase of the cost or increase of the size of the apparatus.

The tray holder may be supported for pivotal motion around an axis extending horizontally and perpendicularly to the discharging direction of the sheet-like media on a body of the stacker station such that the tray holder is changed over between the first state and the second state by pivotal motion of the tray holder around the axis. With the printing apparatus, the number of trays of the stacker station can be increased readily or the stacking capacity of a tray can be increased readily through a simple configuration.

The printing apparatus may be configured such that a recess for fitting with the lower side tray when the tray holder is in the second state is formed on the tray holder such that, in a state wherein the lower side tray is fitted in the recess, an inner face of the lower side tray adjacent the medium exits and an outer face of the tray holder adjacent the side trays are in register with each other and the outer face of the tray holder adjacent the side trays functions, together with the inner face of the lower side tray adjacent the medium exits, as a guide for guiding a sheet-like medium from the upper side medium exit and arranging the position of an end portion of the sheet-like medium adjacent the medium exits. With the printing apparatus, there is an advantage that sheet-type media discharged from the upper side medium exit can be stacked in a good order onto the lower side tray.

The printing apparatus may be configured such that the tray holder in the second state closes up the lower side medium exit and the stacker station further includes a detection element for detecting that the tray holder is in the second state, that the printing station includes a control section for controlling operation of the printing station including discharging operations of the sheet-like media from the two or more medium exits, that the detection section outputs, when it is detected that the tray holder is in the second station, a detection signal to the control station, and that, upon reception of the detection signal from the detection section, the control station controls to stop the discharging of a sheet-like medium from the lower side medium exit and discharge a sheet-like medium from the upper side medium exit. With the printing apparatus, there is an advantage that such a situation that a sheet-type medium is fed into the closed up lower side medium exit to cause paper jamming can be prevented.

A tray full sensor mounted on the tray holder for detecting a fully stacked state of the sheet-like media on the lower side tray when the tray holder is in the first state may be used as the detection element.

In this instance, preferably the tray full sensor includes a lever member mounted on a lower face of the tray holder in the first state above the lower side tray and supported at one end side thereof for pivotal motion on the tray holder, and a sensor element for detecting the other end side of the lever member, and, when the tray holder is in the first state, if the sheet-like media stacked in the lower side tray are not in a fully stacked state, then the other end side of the lever member is positioned spaced away from the sensor element by the weight of the lever member itself, but if the sheet-like media are stacked in a fully stacked state in the lower side tray, then the other end side of the lever member is pushed up to the sensor element by the sheet-like media and detected by the sensor element, whereby the tray full sensor detects the fully stacked state of the sheet-like media. Further preferably, when the tray holder is in the second state, upon the pivotal motion of the tray holder from the first state to the second state, the other end side of the lever member is moved to the position of the sensor element by the weight of the lever member itself and detected by the sensor element, whereby the tray full sensor detects that the tray holder is in the second position. With the printing apparatus, the fully stacked state of sheet-type media received in a stacked state on the lower side tray and that the tray holder is in the second state described above can be detected by the single tray full sensor, and there is an advantage that the number of parts can be reduced.

In this instance, further preferably the printing apparatus is configured such that a discharge sensor is provided for outputting a discharge detection signal to the control section when the discharge sensor detects that a sheet-like medium is discharged to each of the two or more medium exits, and the control section controls, when the detection signal is received form the tray full sensor after the discharge detection signal is received from the discharge sensor for the lower side medium exit, to stop the discharging of a sheet-like medium from the lower side medium exit and urges to issue a tray full alarm, but controls, when the detection signal is received from the tray full sensor although no discharge detection signal is received from the discharge sensor for the lower side medium exit, to stop the discharging of a sheet-like medium from the lower side medium exit and discharge a sheet-like medium from the upper side medium exit. Where the discharge sensor is combined with the tray full sensor in this manner, there is an advantage that it can be discriminated readily whether the tray full sensor detects a fully stacked state of sheet-type media received in a stacked state on the lower side tray or detects that the tray holder is in the second state described above.

Furthermore, the sensor element may be formed from an optical sensor which detects the other end side of the lever member through a light intercepting movement of the other end side of the lever member. With the printing apparatus, there is an advantage that a pivotal movement of the tray holder to the second state can be detected with certainty with a simple configuration.

Further, the distance between the upper side tray and the lower side tray and the installation angle of each of the trays may be set so that, before a trailing end of a sheet-like medium discharged from the upper side medium exit is released from discharge rollers at the upper side medium exit, a leading end of the sheet-like medium arrives at the lower side tray. With the printing apparatus, the possibility that a sheet-type medium discharged from the upper side medium exit may be caught or bent when it drops onto the lower side tray can be reduced, and this is particularly effective where the length of the sheet-type medium discharged from the upper side medium exit is initially known.

Furthermore, the printing apparatus may be configured that, when the control section recognizes that, while it is detected by the detection section that the tray holder is in the second state, the length in the discharging direction of a sheet-like medium designated as a printing object from the outside is shorter than the length of a discharge line for the sheet-like medium from discharge rollers of the upper side medium exit to the lower side tray, the control section controls to stop the discharging of a sheet-like medium from the upper side medium exit and urges to issue an alarm. With the printing apparatus, there is an advantage that, even if the length of a sheet-type medium discharged from the upper side medium exit is not initially known or is not always fixed, the possibility that a sheet-type medium discharged from the upper side medium exit may be caught or bent when it drops onto the lower side tray can be reduced.

BEST MODE FOR CARRYING OUT THE INVENTION

In the following, the best mode for carrying out the present invention is described with reference to the drawings.

It is to be noted that, in the present embodiment, a stacker apparatus of the present invention is applied to a stacker unit which is a component of a printing apparatus, and here, a sheet-type medium such as a paper sheet which is printed by and discharged from a printing station of the printing apparatus is a handled article.

Figure 1:
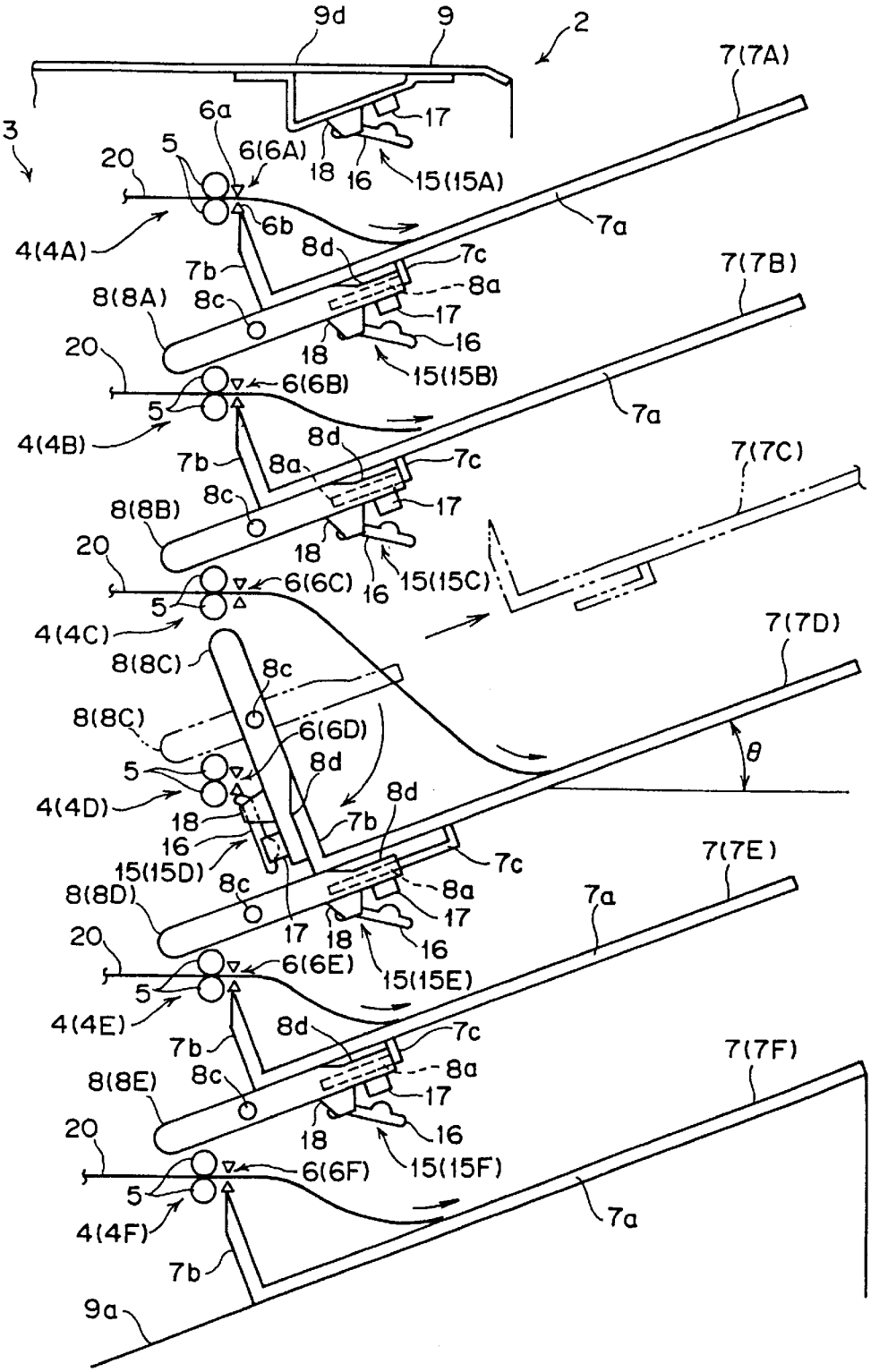
FIG. 1 is a side elevational view showing a configuration of a stacker station of a printing apparatus as an embodiment of the present invention.
Figure 9:
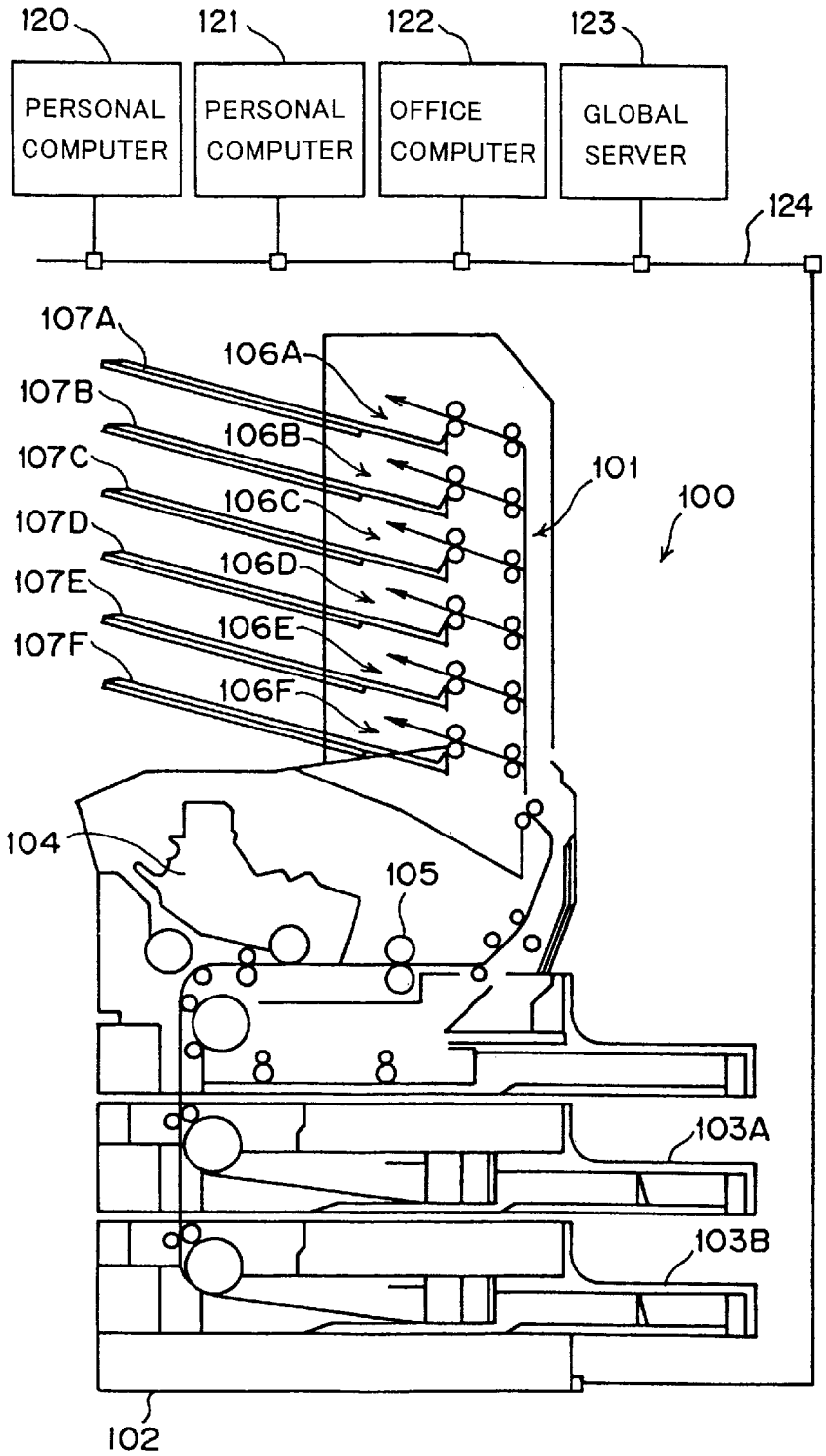
FIG. 9 is a schematic view showing a general configuration of a conventional printing apparatus which has a multi-stage stacker.

FIG. 1 is a side elevational view showing a configuration of the stacker unit of the present printing apparatus, and a configuration of the stacker unit of the present printing apparatus is described in detail with reference to this figure. It is to be noted that, since, for example, such a known configuration as shown in FIG. 9 can be used as a general configuration of the present printing apparatus, description of the other components than the stacker unit is omitted here.

As shown in FIG. 1, the stacker unit (stacker station) 2 is provided in a discharging station 3 of the printing apparatus. Exits (medium exits) 4 are provided in upper and lower six stages in the discharging station 3, and discharging rollers 5, 5 and a discharge sensor 6 are provided for each of the exits 4. The discharging rollers 5, 5 are driven to rotate by a driving apparatus not shown and hold a paper sheet 20, which has been printed by a print unit station (printing station) not shown, therebetween to push out and discharge it toward the stacker unit 2.

The discharge sensor 6 is a sensor which includes a light emitting element 6*a* and a light receiving element 6*b* and does not output an on signal while the light receiving element 6*b* receives light from the light emitting element 6*a* but outputs an on signal when the light is intercepted. The on signal is outputted to a control station not shown of the printing apparatus. When a paper sheet 20 is discharged from the discharging rollers 5, 5, since the light emitting element 6*a* and the light receiving element 6*b* are disconnected from each other by the paper sheet 20, the discharge sensor 6 outputs an on signal, and consequently, the control station detects that a paper sheet 20 has been discharged.

It is to be noted that, when the exits 4 are to be represented distinctly from one another, suffixes A to F are added in order from above to them, but where the exits 4 are designated as a whole, they are represented as exits 4. Further, a similar representation method is used also for the other components such as the discharge sensors 6 and trays 7 which are hereinafter described.

In the stacker unit 2, a tray 7 is provided for each of the exits 4. The tray 7 includes a receiving plate portion 7*a* for receiving paper sheets 20 discharged from the exit 4, and a guide portion 7*b* for preventing load shifting of a stack of paper sheets 20 stacked on the receiving plate portion 7*a* and arranging the positions of end portions of the paper sheets 20 adjacent the exit in order. The receiving plate portion 7*a* is disposed such that the free end side thereof is directed upwardly by a predetermined angle θ with respect to a horizontal direction, and the receiving plate portion 7*a* and the guide portion 7*b* are formed such that they extend at the right angle or substantially at the right angle relative to each other so that paper sheets 20 successively discharged from the exits 4 are stacked in order along the guide portion 7*b* without dropping from the receiving plate portion 7*a*. Meanwhile, the guide portion 7*b* has an upper end extended to a position just below the discharge sensor 6 so that a possible maximum number of paper sheets 20 can be stacked.

As regards holding and securing of the trays 7, only the tray 7F in the lowest stage is supported directly on a bottom portion 9*a* of a housing 9 of the stacker unit 2, and the other trays 7A to 7E are held on and secured to the stacker unit 2 through the tray holders 8A to 8E. In the following, a configuration of the tray holders 8 is described with reference to FIGS. 1 to 5.

The tray holder 8 is a plate-like member and has a connection groove 8*a* for connection to a tray 7 provided at an end portion thereof. The connection groove 8*a* is dug in a widthwise direction (in a depthwise direction in FIG. 1) and fits with a connection plate 7*c* provided in a projecting manner toward the rear end side (guide portion side) on a lower face of the receiving plate portion 7*a* of the trays 7. Then, when the connection plate 7*c* is fitted in the connection groove 8*a*, an upper face of the tray holder 8 is held by and between the connection plate 7*c* and the receiving plate portion 7*a*, whereby the tray 7 is held and secured by the tray holder 8. Further, the positional relationship between the connection plate 7*c* and the connection groove 8*a* is set such that, when the connection plate 7*c* is inserted to the interior of the connection groove 8*a*, the guide portion 7*b* is positioned just below the discharge sensor 6. It is to be noted that the connection plate 7*c* is provided only for the trays 7A to 7E in the upper five stages, and the connection plate 7*c* is not provided for the tray 7F since the tray holder 8 is not used for the tray 7F.

Figure 2:
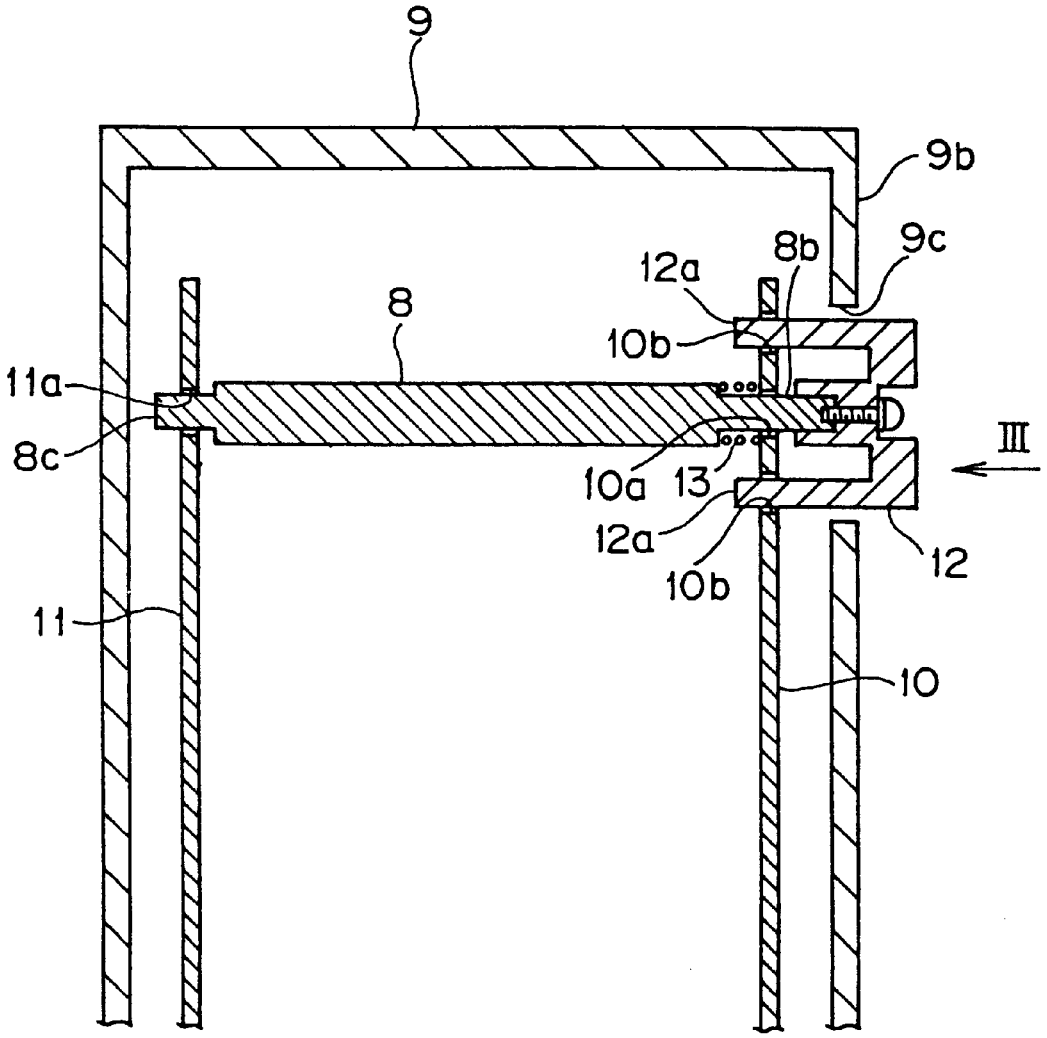
FIG. 2 is a vertical sectional view of a shaft portion showing a configuration of a tray holder of the printing apparatus as the embodiment of the present invention.

Now, a mounting structure for the tray holder 8 is described. As shown in FIG. 2, the tray holder 8 is supported on frames 10, 11 provided in the housing 9 of the stacker unit 2. Support shaft portions 8*b*, 8*c* are provided on the opposite side portions of the tray holder 8, and the support shaft portions 8*b*, 8*c* are supported for rotation by support holes 10*a*, 11*a* provided in the frames 10, 11.

A knob 12 is provided at an end portion of the support shaft portion 8*b* of the tray holder 8. A head portion of the knob 12 projects outwardly from a knob hole 9*c* provided in a side portion 9*b* of the housing 9 such that, by turning the knob 12, the tray holder 8 can be pivoted around an axis provided by the support shaft portions 8*b*, 8*c*. It is to be noted that the axis of pivotal portion of the tray holder 8 extends perpendicularly to the discharging direction of a paper sheet 20 and is set horizontally.

Figure 3:
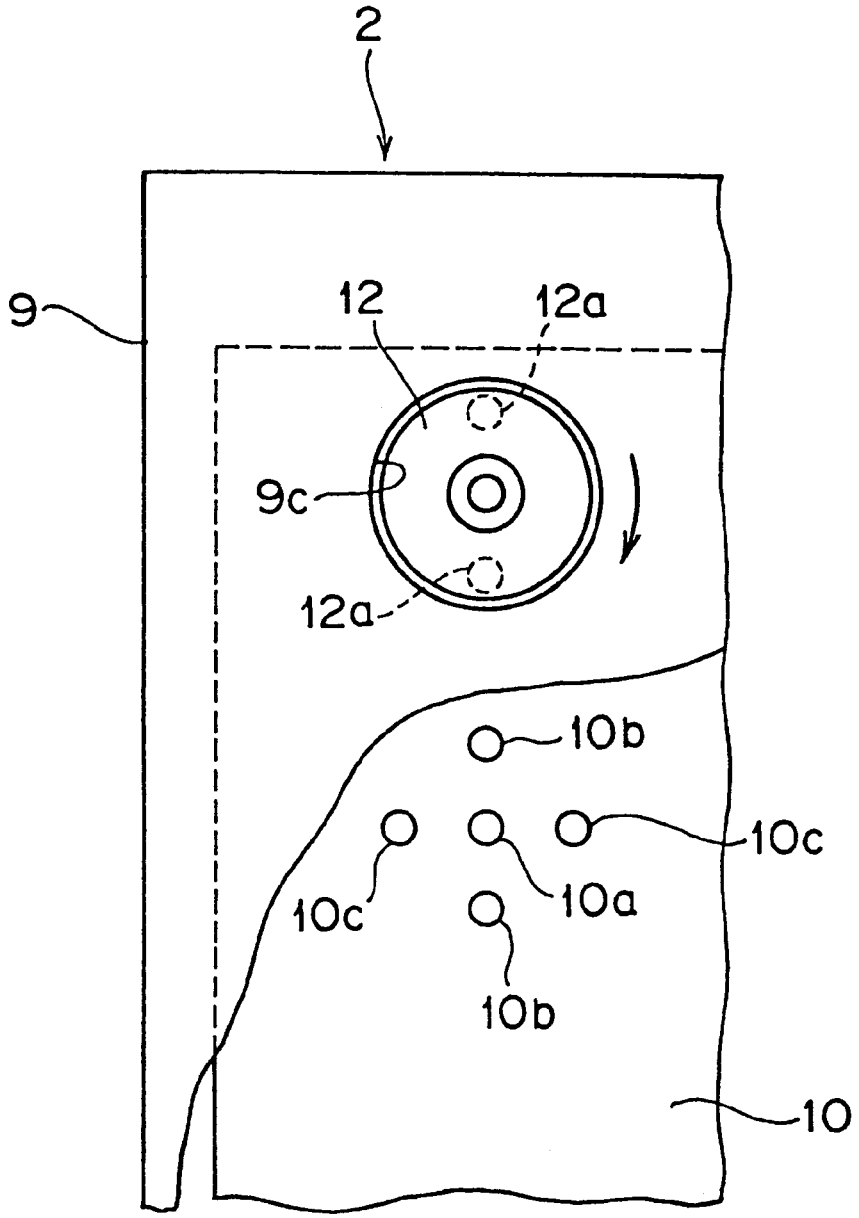
FIG. 3 is a side elevational view as viewed in the direction of an arrow mark III of FIG. 2 showing a configuration of the tray holder of the printing apparatus as the embodiment of the present invention.

Further, as shown in FIGS. 2 and 3, a pair of pawls 12*a*, 12*a* are provided at symmetrical positions with respect to the support shaft portion 8*b* on the knob 12 adjacent the frame 10. Two pairs of engaging holes 10*b*, 10*b* and 10*c*, 10*c* are provided at symmetrical positions with respect to the support hole 10*a* on the frame 10 in a corresponding relationship to the pair of pawls 12*a*, 12*a* as shown in FIG. 3. And, the pivotal motion of the tray holder 8 is restricted and positioned by inserting the pawls 12*a*, 12*a* of the knob 12 into the engaging holes 10*b*, 10*b* or 10*c*, 10*c* of the frame 10.

It is to be noted that a compression spring 13 is provided around the support shaft portion 8*b* as shown in FIG. 2 such that it is held between a side face of the tray holder 8 and the frame 10. Force for drawing the knob 12 to the inner side is exerted by the compression spring 13 so that engagement between the pawls 12*a*, 12*a* and the engaging holes 10*b*, 10*b* or 10*c*, 10*c* is maintained.

The engaging holes 10*b*, 10*b* and the engaging holes 10*c*, 10*c* are provided such that they extend at the right angle or substantially at the right angle relative to each other. The engaging holes 10*b*, 10*b* are provided for holding and securing a tray 7 when the tray 7 is mounted on the tray holder 8, and the other engaging holes 10*c*, 10*c* are provided to release the tray 7 from the tray holder 8 and integrate the tray holder 8 with the tray 7 in the lower stage so that they function as part of a tray for stacking paper sheets 20 discharged from the exit 4 in the upper stage.

In short, when the pawls 12*a*, 12*a* of the knob 12 are engaged with the engaging holes 10*b*, 10*b*, the tray holder 8 is held in a state wherein the free end thereof is directed upwardly at the predetermined angle with respect to the horizontal direction like the tray holders 8A, 8B, 8D and 8E of FIG. 1 (the state of the tray holder 8 in this instance is called first state). Then, by inserting the connection plate 7*c* of the tray 7 into the connection groove 8*a* of the tray holder 8 in this state, the trays 7 is placed into a state wherein it is held and secured and can be used.

On the other hand, when the pawls 12*a*, 12*a* are engaged with the engaging holes 10*c*, 10*c*, the tray holder 8 is held in a state wherein it is inclined with the free end thereof directed downwardly like the tray holder 8C of FIG. 1 and is held at the right angle or substantially at the right angle with respect to the tray holder 8D in the lower stage (the state of the tray holder 8 in this instance is called second state). Then, if the tray 7D is mounted onto the tray holder 8D in the lower stage while the tray holder 8C on the upper stage side is in the state where it is directed downwardly in this manner, then the guide portion 7*b* of the tray 7D is brought into contact, intermediately during the mounting, with the tray holder 8C and is fitted into a recess 8*d* formed on the upper face of the tray holder 8C.

The recess 8*d* is formed such that, in a state wherein it is fitted with the guide portion 7*b*, the inner face of the guide portion 7*b* and the upper face of the tray holder 8C are in flush with each other. Further, the mounting positions of the support shaft portions 8*b*, 8*c* of the tray holder 8 are set such that, when the pawls 12*a*, 12*a* engage with the engaging holes 10*c*, 10*c*, a rear end portion of the tray holder 8 is positioned just below the discharge sensor 6. Accordingly, a flush guide face from the position just below the discharge sensor 6C in the upper stage to the receiving plate portion 7*a* of the tray 7D in the lower stage is formed. Consequently, the tray holder 8C functions as a guide for guiding a paper sheet 20 from the exit 4C on the upper side and arranging the position of the end portion of the paper sheet 20 adjacent the exit together with the guide portion 7*b* of the tray 7D in the lower stage.

Figure 4:
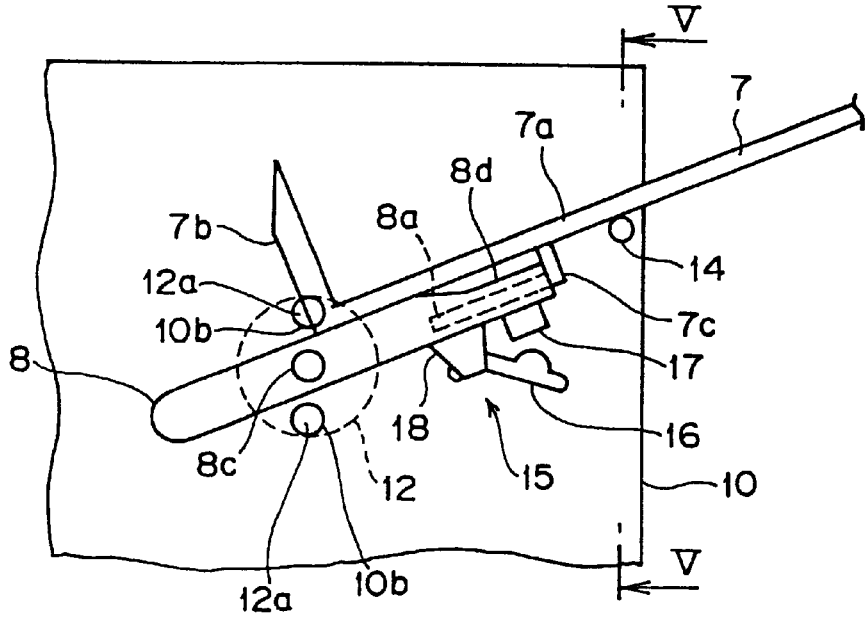
FIG. 4 is a side elevational view showing a tray holding mechanism of the printing apparatus as the embodiment of the present invention.
Figure 5:
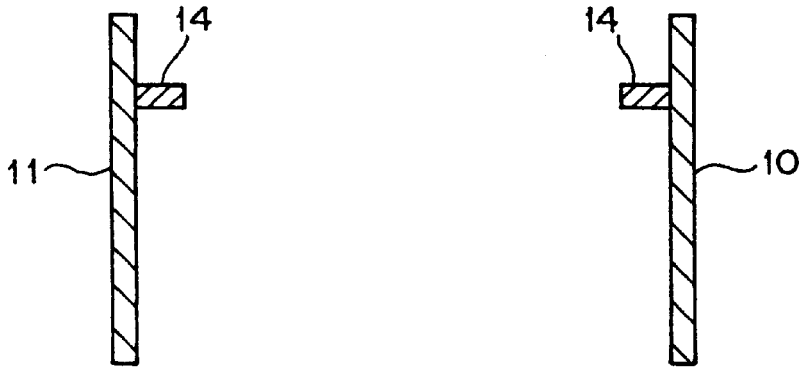
FIG. 5 is a sectional view taken along line V—V of FIG. 4 showing the tray holding mechanism of the printing apparatus as the embodiment of the present invention.

It is to be noted that, when the tray 7D is engaged with the tray holder 8C in the upper stage while the tray holder 8C is in the second state as described above, since the connection plate 7*c* of the tray 7D is not inserted fully to the interior of the connection groove 8*a* of the tray holder 8D, holding and securing by the tray holder 8D for the tray 7D is insufficient. Therefore, stoppers 14, 14 are provided on the left and right frames 10, 11 as shown in FIGS. 4 and 5 and support the lower face of the trays 7. It is to be noted that the stoppers 14, 14 are provided for each of the trays 7A to 7E except the tray 7F in the lowermost stage such that they support a tray 7 from below not only in such a state of use as described above but also in a normal state of use.

As described above, with the present printing apparatus, by turning the knob 12 to change over the tray holder 8 between the first state and the second state, a method of use wherein also the tray 7 in the upper stage is used to assure a greater number of divisions (the setting of the tray arrangement in this instance is called normal setting) and another method of use wherein the tray 7 in the upper stage is removed to increase the stacking capacity of the tray 7 in the lower stage (the setting of the tray arrangement in this instance is called increased amount setting) can be selectively used. However, when the tray holder 8 is set to the second state to select the increased amount setting, since the exit 4 in the lower stage is closed up with the tray holder 8 in the upper stage as shown in FIG. 1, if a paper sheet 20 is discharged from the exit 4 in the lower stage, then paper jamming occurs.

Therefore, in the present printing apparatus, a tray full sensor 15 for detecting that paper sheets 20 are completely (fully) stacked on a tray 7 is used to detect that the exit 4 in the lower stage is closed up with the tray holder 8 in the upper stage.

The tray full sensor 15 includes a lever (lever member) 16 supported at one end thereof by a bracket 18 for pivotal motion at the other end thereof, and a sensor element 17 provided on a locus of rocking motion of the lever 16 on the downstream side of the bracket 18 in the discharging direction of a paper sheet 20. Although, for example, a mechanical switch which is switched on when the lever 16 is brought into contact therewith can be used as the sensor element 17, here a contactless optical sensor for minimizing the resistance to act upon a paper sheet 20 to be discharged thereby to prevent paper jamming is used. The optical sensor outputs an on signal by a light intercepting movement of the lever 16.

The tray full sensor 15 is provided for each of the trays 7A to 7F, and the tray full sensor 15A for the tray 7A in the uppermost stage is mounted on a lower face of a ceiling portion 9*d* of the housing 9 while the tray full sensors 15B to 15F for the other trays 7B to 7F are each mounted on a lower face at a free end portion of a tray holder 8A to 8E in the upper stage. And, the fully stacked states with paper sheets 20 stacked on the trays 7A to 7F are detected by the tray full sensors 15A to 15F, respectively.

A detection operation of the tray full sensor 15 when it detects the fully stacked state of a tray 7 is described. First, an initial stage wherein no paper sheet 20 is stacked on the tray 7, the lever 16 of each of the tray full sensors 15 is in a state wherein it hangs downwardly by the weight of itself, and in this state, since the lever 16 is spaced away from the sensor element 17, the output of the sensor element 17 is off. Then, as paper sheets 20 are successively discharged from the exit 4 and stacked on the tray 7, the stacked paper sheet 20 soon pushes the lever 16 upwardly. When the lever 16 is pushed up to a predetermined distance with respect to the sensor element 17, the sensor element 17 is turned on by a light intercepting movement of the lever 16 and outputs an on signal to the control station of the printing apparatus.

By the way, since the tray full sensors 15B to 15F except the tray full sensor 15A in the uppermost stage are mounted on the tray holders 8A to 8E, respectively, when the tray holders 8A to 8E are pivoted to their second state, also the tray full sensors 15B to 15F are pivoted integrally.

At this time, since the lever 16 is supported for rocking motion on the tray holder 8 through the bracket 18, when the tray holder 8 is inclined to some degree, the lever 16 hangs down from the tray holder 8 while keeping a fixedly inclined state by the weight of itself irrespective of the inclined state of the tray holder 8 so that the lever 16 relatively approaches the sensor element 17 which pivots integrally with the tray holder 8. Then, when the tray holder 8 is pivoted to the second state, the lever 16 is positioned in the proximity of the sensor element 17, and by the light intercepting movement of the lever 16, the sensor element 17 outputs an on signal to the control station of the printing apparatus.

In this manner, an on signal is outputted from the tray full sensor 15 in two states when the tray 7 is placed into a fully stacking state and when the tray holder 8 is placed into the second state, that is, when the exit 4 in the lower stage is closed up. However, if only the signal from the tray full sensor 15 is used, then it cannot be discriminated which one of the states the signal indicates. Therefore, the control station of the printing apparatus refers to a signal from the discharge sensor 6 in addition to the signal from the tray full sensor 15 to discriminate in which one of the states the tray 7 is, and effects control in accordance with the discriminate state.

Figure 6:
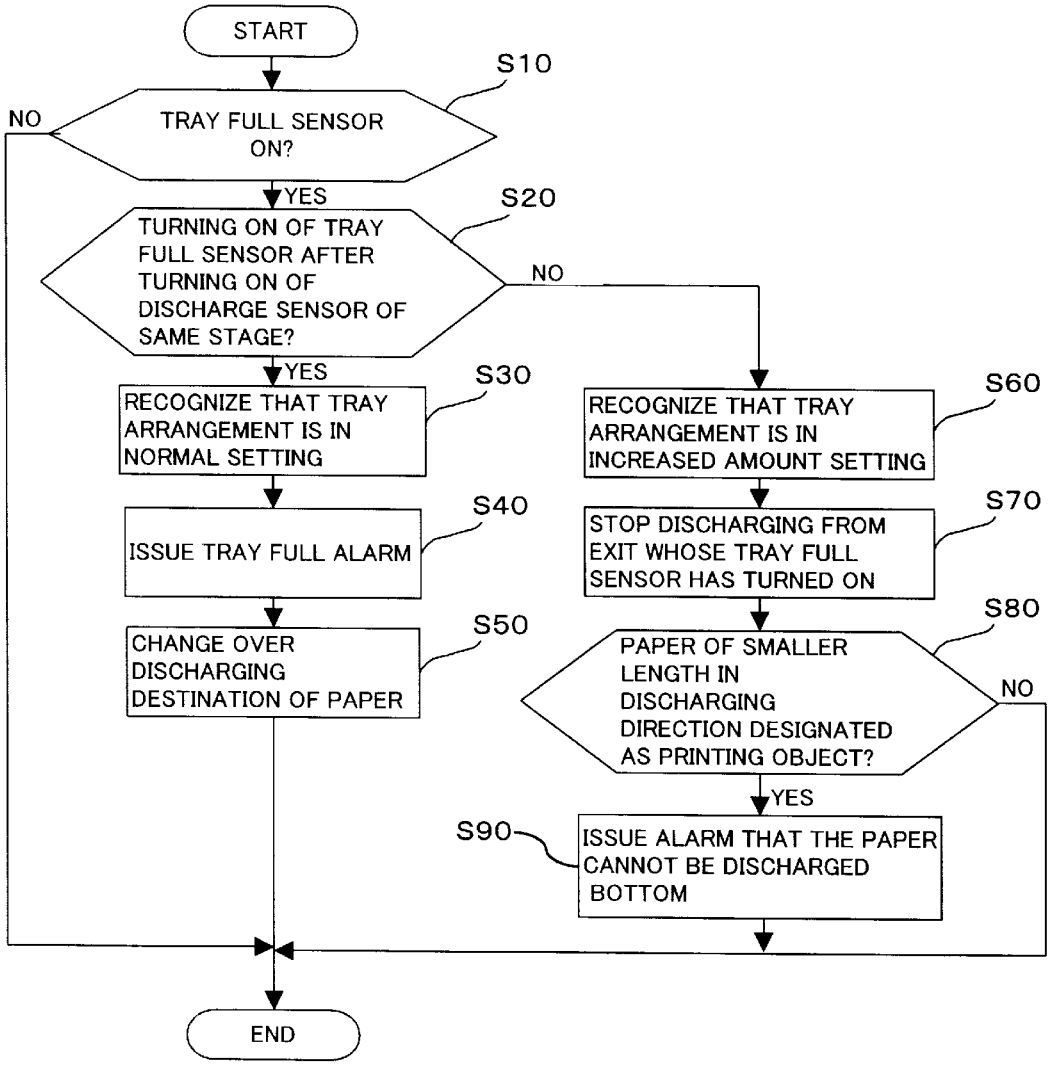
FIG. 6 is a flow chart illustrating a controlling method for the stacker station of the printing apparatus as the embodiment of the present invention.

In the following, a discrimination method of a state of a tray and contents of control based on a result of the discrimination by the control station are described with reference to a flow chart (steps S10 to S90) shown in FIG. 6. It is to be noted that the control station is means for controlling operation of the entire printing apparatus including an operation of discharging a paper sheet 20 from an exit 4 and includes such functional elements as a CPU, a RAM, a ROM and an input/output interface such that the control described below is executed by cooperation of the functional elements.

First, the control station discriminates whether or not an on signal from the tray full sensor 15 is inputted (step S10). If an on signal is inputted from the tray full sensor 15, then the control station discriminates whether or not an on signal was inputted from the discharge sensor 6 in the same stage as that of the tray full sensor 15 within a predetermined time before the on signal is inputted (step S20).

Here, if an on signal was inputted from the discharge sensor 6 (refer to the YES route of step S20), then since it is considered that paper sheets 20 discharged from the exit 4 of the stage push up the lever 16 and the sensor element 17 is turned on by a light intercepting movement of the lever 16, the control station considers that the on signal from the tray full sensor 15 is a signal indicating that the tray 7 has been placed into a fully stacking state and recognizes that the tray arrangement in the stacker unit 2 is in the normal setting (step S30).

Then, in this instance, the control station issues a tray full alarm indicating that the tray 7 is in a fully stacking state to terminals (refer to FIG. 9) such as a personal computer connected to the printing apparatus and further causes a lamp not shown to be lit or causes a buzzer to emit sound to issue a notification of the fully stacking state of the tray 7 to the outside (step S40). Further, the control station stops the discharging of a paper sheet 20 to the tray 7 which has been placed into the fully stacking state and changes over the discharging destination of a paper sheet 20 to another tray 7 which is free from allocation or changes over, when no free tray 7 is available, the discharging destination to a tray 7 set in advance (step S50).

On the other hand, if an on signal was not inputted from the discharge sensor 6 (refer to the NO route of step S20), then since it is considered that not the lever 16 has been pushed up by discharged paper sheets 20 but the tray holder 8 in the upper stage has been pivoted to the second state, whereupon the lever 16 has approached the sensor element 17 and the sensor element 17 has been turned on by a light intercepting movement of the sensor element 17, the control station recognizes that the tray arrangement in the stacker unit 2 is in the increased amount setting (step S60).

Then, in this instance, in order to prevent paper jamming caused by discharging of a paper sheet 20 from the exit 4 in the lower stage closed up with the tray holder 8 in the upper stage, the control station first issues an alarm for inhibiting the discharging from the exits 4 to the terminal such as a personal computer connected to the printing apparatus and controls either to compulsorily stop the discharging from the exit 4 or, for example, where the allocation of a terminal or an operation is the same between the exit 4 and the exit 4 in the upper stage, to change over the discharging destination to the exit 4 in the upper stage (step S70).

Further, after the tray arrangement is changed to the increased amount setting in this manner, a paper sheet 20 is discharged from the exit 4 in the upper stage to the tray 7 in the lower stage, and the length of the discharging line of a paper sheet 20 from the exit 4 to the tray 7 becomes longer. Therefore, whether the paper sheet 20 has a small length in the discharging direction, for example, like a paper sheet of the A5 size, the trailing end of the paper sheet 20 is released from the discharging rollers 5, 5 before the leading end of the paper sheet 20 reaches the tray 7, and the paper sheet 20 cannot be stacked well on the tray 7. Therefore, when print data is transmitted from a terminal, the control station discriminates whether or not the length in the discharging direction of a paper sheet 20 designated as an object of printing is shorter than the length of the discharging line (step S80). Then, if the length in the discharging direction is shorter (refer to the YES route in step S80), then the control station controls to stop the discharging from the exit 4 in the upper stage and issues an alarm representing that the discharging to the exit 4 is not allowed prior to printing to the terminal from which the data has been transmitted (step S90).

Figure 7:
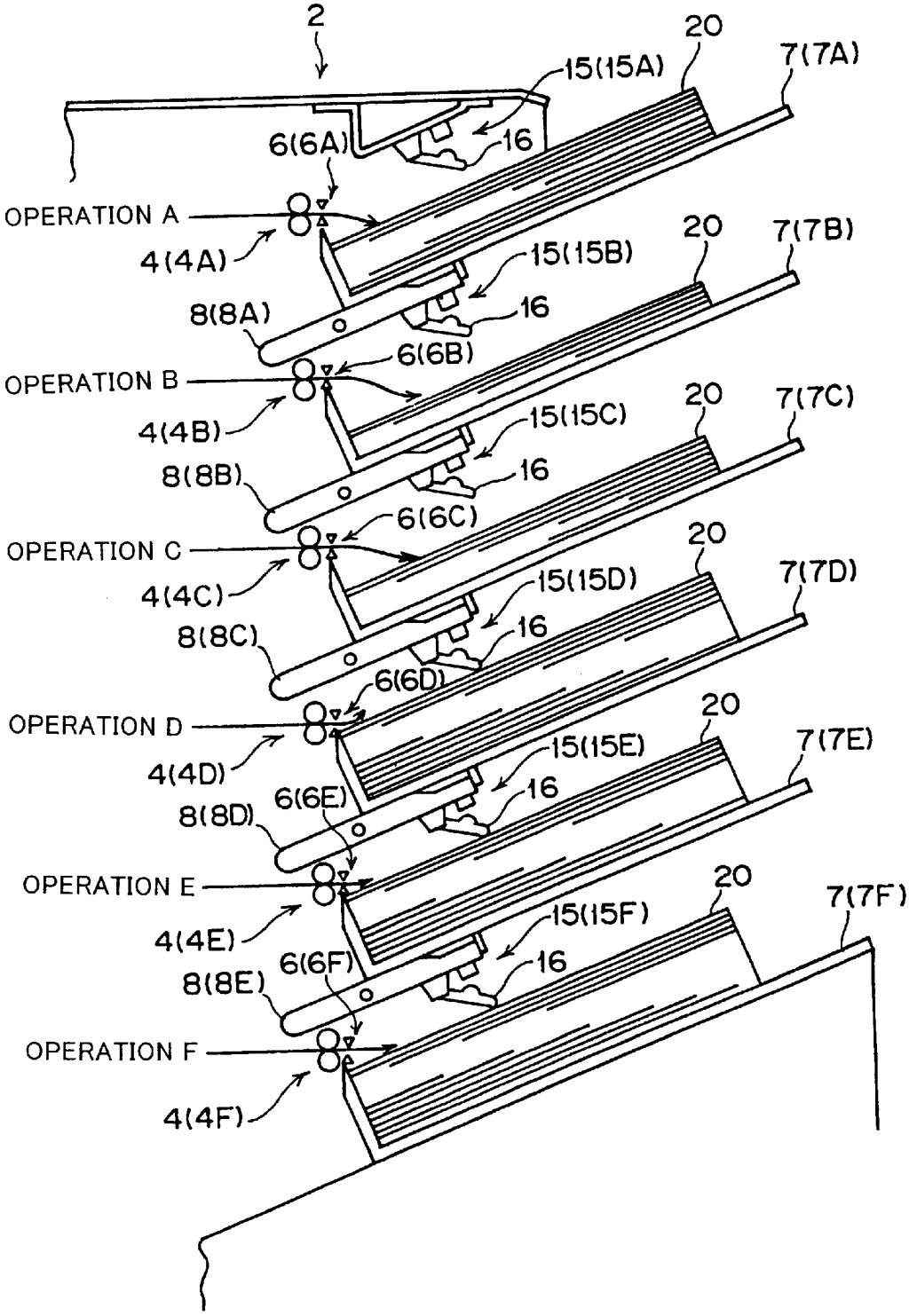
FIG. 7 is a view showing a form of use of the printing apparatus as the embodiment of the present invention and showing a normal form of use.
Figure 8:
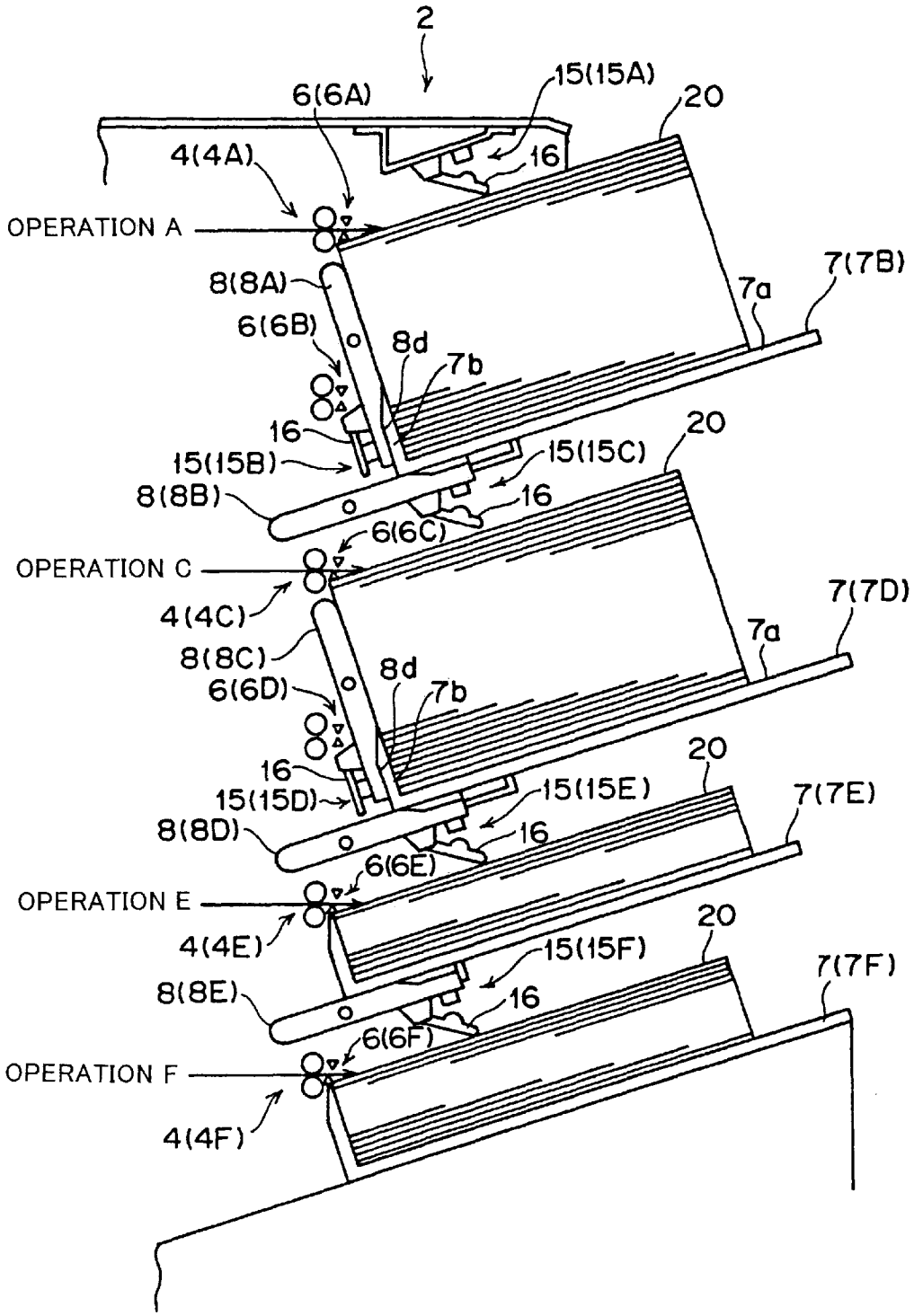
FIG. 8 is a view showing another form of use of the printing apparatus as the embodiment of the present invention and showing a form of use were the stacking capacity of a tray is increased.

The configuration of the printing apparatus which includes the stacker apparatus as the best form for carrying out the present invention is such as described in detail above, and by changing over the fixed position of the tray holder 8 in such a manner as described above, the two tray arrangements of the normal setting and the increased amount setting can be selectively set. Here, FIG. 7 shows a state of use of the present printing apparatus where the normal setting is selected while FIG. 8 shows an example of a state of use of the present printing apparatus where the increased amount setting is selected. In the following, operation of the present printing apparatus when it is used is described with reference to FIGS. 7 and 8.

First, where the tray arrangement is the normal setting as shown in FIG. 7, discharging of a paper sheet 20 from all of the exits 4 is permitted, and a number of different operations equal to the number of the exits 4 provided for the printing apparatus can be handled. For example, in the case shown in FIG. 7, a paper sheet 20 can be discharged to any one of the trays 7 of 6 stages from the tray 7A in the uppermost state to the tray 7F in the lowermost stage. Therefore, the trays 7 can be allocated to six operations in the maximum. Here, the operations A, B, C, D, E and F are allocated in order from the tray 7A in the uppermost state.

In this instance, the amount of paper sheets 20 which can be stacked on the trays 7 is equal to a reference value (here, it is assumed that the reference value is 150 paper sheets), and if the amount of paper sheets 20 exceeds the reference value or comes close to the reference value, then the paper sheets 20 push up the lever 16, whereupon the tray full sensor 15 reacts to output an on signal to the control station. When the discharged paper sheets 20 push up the lever 16 until the tray full sensor 15 reacts in this manner, since also the discharge sensor 6 outputs an on signal prior to this, the control station recognizes that the tray 7 has been placed into a fully stacking state in accordance with the control flow illustrated in FIG. 6. Thus, the control station issues a tray full alarm to the terminals connected to the printing apparatus and controls the lamp not shown to be lit or controls the buzzer to emit sound. Further, since different operations are allocated to all of the trays 7 and there is no tray 7 free from allocation, the control station changes over the discharging destination to a tray 7 set in advance (for example, the tray 7 in the uppermost state).

Here, it is assumed that, for example, the operation B and the operation D have no operation while the operation A and the operation C are operations which involve printing by a large amount. In this instance, the tray 7B and the tray 7D to which the operation B and the operation D are allocated are not used at all while such a situation that the stacking capacity is short and a tray full alarm is issued in a moment occurs with the tray 7A and the tray 7C to which the operation A and the operation C are allocated.

In such an instance, the tray arrangement is changed over to the increased amount setting as shown in FIG. 8 to increase the stacking capacity of the trays 7 to which the operation A and the operation C are allocated. Describing more particularly, when the stacking capacity of the tray 7 allocated to the operation A is to be increased, the tray 7A for the exit 4A from which a paper sheet 20 relating to the operation A is discharged and the tray 7B in the stage below the tray 7A are removed from the tray holders 8A, 8B, respectively. Then, the tray holder 8A on the upper stage side is pivoted and fixed to the second state, and then the tray 7B in the lower stage is mounted onto the tray holder 8B.

Consequently, the tray holder 8B is integrated with the guide portion 7*b* of the tray 7B to function as a guide element for guiding a paper sheet 20 discharged from the exit 4A and arranging discharged paper sheets 20 on the exit side, and paper sheets 20 discharged from the exit 4A in the upper stage are successively stacked onto the tray 7B in the lower stage. Further, this similarly applies to a case wherein the stacking capacity of the tray 7 to which the operation C is allocated is to be increased. In particular, the tray 7C on the upper stage side is removed, and the tray holder 8C is pivoted to and fixed at the second state. Then, the tray 7D in the lower stage is mounted onto the tray holder 8D so that paper sheets 20 relating to the operation C discharged from the exit 4C are successively stacked onto the tray 7D.

And, the stacking capacity at this time is not simply equal to that of the two stages of trays 7 (150 sheets×2=300 sheets), but a capacity corresponding to the gap between the trays 7 is added. Therefore, a stacking capacity greater than that of two stages of trays 7 (for example, approximately 350 sheets) can be assured, and an operation which involves a large amount of prints can be coped with sufficiently.

Further, at this time, as the tray holder 8A or 8C is pivoted to the second state, the tray full sensor 15B or 15D provided for the tray holder 8A or 8C reacts to output an on signal. However, since no signal is inputted from the discharge sensor 6B or 6D, the control station recognizes that the exit 4B or 4D in the lower stage is closed up with the tray holder 8A or 8C in accordance with the control flow illustrated in FIG. 6, and issues an alarm for inhibiting the discharging from the exit 4B or 4D to the terminals and controls to compulsorily stop the discharging from the exit 4B or 4D. Accordingly, paper jamming caused by discharging of a paper sheet 20 from the closed up exit 4B or 4D is prevented.

It is to be noted that, where the changing over setting from the closed up exit 4B or 4D to the exit 4A or 4C in the upper stage is performed, for example, where mixture of paper sheets 20 of the operation B and paper sheets 20 of the operation A and mixture of paper sheets 20 of the operation C and paper sheets 20 of the operation D are permissible from the relationship of the contents of the operations or the discharged amounts of paper sheets 20 or in a like case, if a printing instruction relating to the operation B or the operation D is issued, the printed paper sheets 20 are discharged from the exit 4A or 4C of the changing over destination.

Further, since, in the increased amount setting, the range of a paper sheet 20 from the exit 4A to the tray 7B or from the exit 4C to the tray 7D is greater than that in the normal setting, the control station issues to the terminals an alarm representing that a paper sheet 20 having a length greater than the range cannot be discharged from the exit 4A or 4C and controls to compulsorily stop the discharging from the exit 4A and 4C. Accordingly, load shifting of the stack on the tray 7B or 7D caused by a paper sheet 20 of a smaller length discharged from the exit 4A or the exit 4C at a higher position is prevented.

In this manner, according to the printing apparatus as the best form for carrying out the present invention, when a greater number of divisions are required, this requirement can be satisfied by mounting trays 7 into the individual tray holders 8 and using the trays 7 as discharging destinations. However, when a high stacking capacity is required, this requirement can be satisfied by removing a tray 7 from the tray holder 8 in the upper stage and changing over the tray holder 8 from which the tray 7 has been removed from the first state to the second state so that it functions as part of a tray for stacking paper sheets 20 from the exit 4 in the upper stage together with the tray 7 in the lower stage. Consequently, there is an advantage that the number of trays 7 or the stacking capacity of the trays 7 can be set in accordance with the needs of a customer such as a form of operation without inviting increase of the cost or increase of the size of the apparatus.

And, since the changing over of the tray holder 8 from the first state to the second state can be performed only by turning the knob 13 to pivot the tray holder 8 around the support shaft portions 8*b* and 8*c*, there is an advantage that the number of exits can be increased readily or the stacking capacity of a tray can be increased.

Further, when the tray holder 8 in the upper stage is set to the second state, the guide portion 7*a* of the tray 7 in the lower stage is fitted in the recess 8*d* formed on the upper face of the tray holder 8 in the upper stage such that the tray holder 8 and the guide portion 7*a* become in flush with each other, and the tray holder 8 cooperates with the guide portion 7*a* of the tray 7 in the lower stage to function as a guide which guides a paper sheet 20 discharged from the exit 4 in the upper stage and arranges the positions of end portions of paper sheets 20 adjacent the exit 4 to each other. Therefore, there is an advantage that paper sheets 20 discharged from the exit 4 in the upper stage can be stacked in a good order on the tray holder 8 in the lower stage.

Further, when the tray holder 8 in the upper stage is in the second state, the control station controls to stop the discharging of a paper sheet 20 from the exit 4 in the lower stage and discharge a paper sheet 20 from the exit 4 in the upper stage. Therefore, there is an advantage that such a situation that a paper sheet 20 is fed into the closed up exit 4 in the lower stage to cause paper jamming can be prevented. Furthermore, that the tray holder 8 in the upper stage has been placed into the second state is discriminated based on the signal of the tray full sensor 15 mounted on the tray holder 8 in the upper stage for detecting a fully stacking state of the tray 7 in the lower stage. Therefore, there is an advantage that there is no necessity to provide a sensor for exclusive use and the number of parts can be reduced.

Further, in this instance, the control station performs the discrimination based on the signal of the discharge sensor 6 for detecting discharging of a paper sheet 20 from the exit 4 in combination with the signal of the tray full sensor 15. Therefore, there is an advantage that it can be discriminated readily and with certainty whether the tray full sensor 15 detects a fully stacking state of the tray 7 or detects that the tray holder 8 is in the second state.

And, since an optical sensor which is turned on by a light intercepting movement of the lever 16 supported for rocking motion on the bracket 18 is adopted as the sensor element 17 of the tray full sensor 15, there is an advantage that a pivotal movement of the tray holder 8 to the second state can be detected with certainty with a simple configuration without disturbing the discharging of a paper sheet 20.

Furthermore, where the length in the discharging direction of a paper sheet 20 designated as a printing object from the outside when the tray holder 8 in the upper stage is in the second state is smaller than the length of the discharging line for a paper sheet 20 from the discharging rollers 5, 5 at the exit 4 in the upper stage to the tray 7 in the lower stage, the control station controls to stop the discharging of a paper sheet 20 from the exit 4 in the upper stage and issues an alarm to the terminals. Therefore, there is an advantage that the possibility that a paper sheet 20 discharged from the exit 4 in the upper stage may be caught or bent when it drops onto the tray 7 in the lower stage can be reduced and paper sheets 20 discharged can be stacked in a good order on the tray 7.

It is to be noted that the present invention is not limited to the embodiment described above but can be carried out in various modified forms within the scope of the present invention. For example, the number of trays 7 installed is not limited to six stages, but a required number of stages of trays 7 can be installed. This also applies to the installation distance between the trays 7, that is, the stacking capacity, and the stacking capacity is not limited to the specified number of 150 sheets given as an example, but can be set to a required stacking capacity.

Further, where the length in the discharging direction of a paper sheet 20 to be discharged from the exit 4 in the upper stage is fixed, the distance in the upper and lower directions between the tray 7 in the upper stage and the tray 7 in the lower stage and the installation angle θ of each tray 7 with respect to the horizontal plane may be set such that the leading end of a paper sheet 20 discharged from the exit 4 in the upper stage reaches the tray 7 in the lower stage before the trailing end of the paper sheet 20 is released from the discharging rollers 5, 5. In this instance, there is an advantage that the possibility that a paper sheet 20 discharged from the exit 4 in the upper stage may be caught or bent when it drops onto the tray 7 in the lower stage is reduced and discharged paper sheets 20 can be stacked in a good order on the tray 7.

Furthermore, while, in the embodiment described above, the stacker apparatus of the present invention is applied to a stacker unit which is a component of a printing apparatus, the stacker apparatus of the present invention is not limited to a printing apparatus of a printer, a copying machine or the like, but can be applied to general equipments which include a stacker apparatus which sorts comparatively thin articles (sheet-type media) such as, for example, a sorting machine (sorter) for mails or magazines and has a plurality of exits in upward and downward directions so that sorted articles are successively stacked.

INDUSTRIAL APPLICABILITY OF THE INVENTION

As described above, the stacker apparatus of the present invention is useful to collect sheet-like media discharged from two or more medium exits disposed in upward and downward directions in layers for the individual medium exits, and is particularly suitable to application of an apparatus for which it is demanded to variably set the number of trays or the stacking capacity of each tray when necessary.

Further, the printing apparatus of the present invention is useful to collect printed sheet-like media in layers into trays for individual contents of operations and is particularly suitable to variable setting of the number of trays or the stacking capacity of each tray of a stacking station when necessary.

What is claimed is:

1. A stacker apparatus which includes a plurality of trays (7A to 7F) for receiving sheet-like media (20) discharged from two or more medium exits (4A to 4F) disposed in upward and downward directions separately and individually for said medium exits (4) in a stacked state, characterized in that, between two upper and lower medium exits (4C, 4D) included in said two or more medium exits (4A to 4F), a tray holder (8C) on which the upper side tray (7C) for receiving the sheet-like media (20) discharged from the upper side medium exit (4C) of the two upper and lower medium exits (4C, 4D) in a stacked state can be removably and securely held is disposed, and that said tray holder (8C) is selectively changed over to one of a first state wherein said tray holder (8C) securely holds said upper side tray (7C) when said upper side tray (7C) is mounted thereon and a second state wherein said tray holder (8C) releases said upper side tray (7C) and operates integrally with the lower side tray (7D) provided for receiving the sheet-like media (20) discharged from the lower side medium exit (4D) of said two upper and lower medium exits (4C, 4D) in a stacked state to function as part of a tray for receiving the sheet-like media (20) from the upper side medium exit (4C) in a stacked state together with said lower side tray (7D).

2. The stacker apparatus as set forth in claim 1, characterized in that said tray holder (8C) is supported for pivotal motion around an axis (8*b*, 8*c*) extending horizontally and perpendicularly to the discharging direction of the sheet-like media (20) on a body (9, 10) of said stacker apparatus such that said tray holder (8C) is changed over between the first state and the second state by pivotal motion of said tray holder (8C) around said axis.

3. The stacker apparatus as set forth claim 2, characterized in that a recess (8*d*) for fitting with said lower side tray (7D) when said tray holder (8C) is in the second state is formed on said tray holder (8C) such that, in a state wherein said lower side tray (7D) is fitted in said recess (8*d*), an inner face of said lower side tray (7D) adjacent said medium exits (4) and an outer face of said tray holder (8C) adjacent said side trays (7) are in register with each other and the outer face of said tray holder (8C) adjacent said side trays (7) functions, together with the inner face of said lower side tray (7D) adjacent said medium exits (4), as a guide for guiding a sheet-like medium (20) from said upper side medium exit (4C) and arranging the position of an end portion of the sheet-like medium (20) adjacent said medium exits (4).

4. The stacker apparatus as set forth claim 2 or 3, characterized in that said tray holder (8C) in the second state closes up said lower side medium exit (4D) and said stacker apparatus further comprises a detection element for detecting that said tray holder (8C) is in the second state, and that said detection element outputs, when it is detected that said tray holder (8C) is in the second state, a detection signal as an instruction signal for urging to stop the discharging of a sheet-like medium (20) from said lower side medium exit (4D) and discharge a sheet-like medium (20) from said upper side medium exit (4C).

5. The stacker apparatus as set forth claim 4, characterized in that a tray full sensor (15D) mounted on said tray holder (8C) for detecting a fully stacked state of the sheet-like media (20) on said lower side tray (7D) when said tray holder (8C) is in the first state is used as said detection element.

6. The stacker apparatus as set forth claim 5, characterized in that said tray full sensor (15D) includes a lever member (16) mounted on a lower face of said tray holder (8C) in the first state above said lower side tray (7D) and supported at one end side thereof for pivotal motion on said tray holder (8C), and a sensor element (17) for detecting the other end side of said lever member (16), and that, when said tray holder (8C) is in the first state, if the sheet-like media (20) stacked in said lower side tray (7D) are not in a fully stacked state, then the other end side of said lever member (16) is positioned spaced away from said sensor element (17) by the weight of said lever member (16) itself, but if the sheet-like media (20) are stacked in a fully stacked state in said lower side tray (7D), then the other end side of said lever member (16) is pushed up to said sensor element (17) by the sheet-like media (20) and detected by said sensor element (17), whereby said tray full sensor (15D) detects the fully stacked state of the sheet-like media (20).

7. The stacker apparatus as set forth in claim 6, characterized in that, when said tray holder (8C) is in the second state, upon the pivotal motion of said tray holder (8C) from the first state to the second state, the other end side of said lever member (16) is moved to the position of said sensor element (17) by the weight of said lever member (16) itself and detected by said sensor element (17), whereby said tray full sensor (15D) detects that said tray holder (8C) is in the second position.

8. The stacker apparatus as set forth in claim 7, characterized in that the detection signal outputted from said tray full sensor (15D) as a result of detection of the other end side of said lever member (16) after discharging of a sheet-like medium (20) from said lower side medium exit (4D) is detected is used as an instruction signal for urging to stop the discharging of a sheet-like medium (20) from said lower side medium exit (4D) and issue a tray full alarm, and that the detection signal outputted from said tray full sensor (15D) as a result of detection of the other end side of said lever member (16) although discharging of a sheet-like medium (20) from said lower side medium exit (4D) is not detected is used as an instruction signal for urging to stop the discharging of a sheet-like medium (20) from said lower side medium exit (4D) and discharge a sheet-like medium (20) from said upper side medium exit (4C).

9. The stacker apparatus as set forth in claim 6, characterized in that said sensor element (17) is formed from an optical sensor which detects the other end side of said lever member (16) through a light intercepting movement of the other end side of said lever member (16).

10. The stacker apparatus according to any one of claims 1 to 3, characterized in that the distance between said upper side tray (7C) and said lower side tray (7D) and the installation angle (θ) of each of said trays (7) are set so that, before a trailing end of a sheet-like medium (20) discharged from said upper side medium exit (4C) is released from discharge rollers (5, 5) at said upper side medium exit (4C), a leading end of the sheet-like medium (20) arrives at said lower side tray (7D).

11. A printing apparatus, characterized in that it comprises a printing station for printing a sheet-like medium (20) and discharging the sheet-like medium (20) from one of two or more medium exits (4A to 4F) disposed in upward and downward directions, and a stacker station (2) including a plurality of trays (7A to 7F) for receiving sheet-like media (20) discharged from said two or more medium exits (4A to 4F) of said printing station separately and individually for said medium exits (4) in a stacked state, that in said stacker station (2), between two upper and lower medium exits (4C, 4D) included in said two or more medium exits (4A to 4F), a tray holder (8C) on which the upper side tray (7C) for receiving the sheet-like media (20) discharged from the upper side medium exit (4C) of the two upper and lower medium exits (4C, 4D) in a stacked state can be removably and securely held is disposed, and that said tray holder (8C) is selectively changed over to one of a first state wherein said tray holder (8C) securely holds said upper side tray (7C) when said upper side tray (7C) is mounted thereon and a second state wherein said tray holder (8C) releases said upper side tray (7C) and operates integrally with the lower side tray (7D) provided for receiving the sheet-like media (20) discharged from the lower side medium exit (4D) of said two upper and lower medium exits (4C, 4D) in a stacked state to function as part of a tray (7) for receiving the sheet-like media (20) from the upper side medium exit (4C) in a stacked state together with said lower side tray (7D).

12. The printing apparatus as set forth in claim 11, characterized in that said tray holder (8C) is supported for pivotal motion around an axis extending horizontally and perpendicularly to the discharging direction of the sheet-like media (20) on a body of said stacker station such that said tray holder (8C) is changed over between the first state and the second state by pivotal motion of said tray holder (8C) around said axis.

13. The printing apparatus as set forth claim 12, characterized in that a recess (8*d*) for fitting with said lower side tray (7D) when said tray holder (8C) is in the second state is formed on said tray holder (8C) such that, in a state wherein said lower side tray (7D) is fitted in said recess (8*d*), an inner face of said lower side tray (7D) adjacent said medium exits (4) and an outer face of said tray holder (8C) adjacent said side trays (7) are in register with each other and the outer face of said tray holder (8C) adjacent said side trays (7) functions, together with the inner face of said lower side tray (7D) adjacent said medium exits (4), as a guide for guiding a sheet-like medium (20) from said upper side medium exit (4C) and arranging the position of an end portion of the sheet-like medium (20) adjacent said medium exits (4).

14. The printing apparatus as set forth in claim 12 or 13, characterized in that said tray holder (8C) in the second state closes up said lower side medium exit (4D) and said stacker station further includes a detection element for detecting that said tray holder (8C) is in the second state, that said printing station includes a control section for controlling operation of said printing station including discharging operations of the sheet-like media (20) from said two or more medium exits (4A to 4F), that said detection section outputs, when it is detected that said tray holder (8C) is in the second station, a detection signal to said control station, and that, upon reception of the detection signal from said detection section, said control station controls to stop the discharging of a sheet-like medium (20) from said lower side medium exit (4D) and discharge a sheet-like medium (20) from said upper side medium exit (4C).

15. The printing apparatus as set forth claim 14, characterized in that a tray full sensor (15D) mounted on said tray holder (8C) for detecting a fully stacked state of the sheet-like media (20) on said lower side tray (7D) when said tray holder (8C) is in the first state is used as said detection element.

16. The printing apparatus as set forth claim 15, characterized in that said tray full sensor (15D) includes a lever member (16) mounted on a lower face of said tray holder (8C) in the first state above said lower side tray (7D) and supported at one end side thereof for pivotal motion on said tray holder (8C), and a sensor element (17) for detecting the other end side of said lever member (16), and that, when said tray holder (8C) is in the first state, if the sheet-like media (20) stacked in said lower side tray (7D) are not in a fully stacked state, then the other end side of said lever member (16) is positioned spaced away from said sensor element (17) by the weight of said lever member (16) itself, but if the sheet-like media (20) are stacked in a fully stacked state in said lower side tray (7D), then the other end side of said lever member (16) is pushed up to said sensor element (17) by the sheet-like media (20) and detected by said sensor element (17), whereby said tray full sensor (15D) detects the fully stacked state of the sheet-like media (20).

17. The printing apparatus as set forth in claim 16, characterized in that, when said tray holder (8C) is in the second state, upon the pivotal motion of said tray holder (8C) from the first state to the second state, the other end side of said lever member (16) is moved to the position of said sensor element (17) by the weight of said lever member (16) itself and detected by said sensor element (17), whereby said tray full sensor (15D) detects that said tray holder (8C) is in the second position.

18. The printing apparatus as set forth in claim 17, characterized in that a discharge sensor is provided for outputting a discharge detection signal to said control section when said discharge sensor detects that a sheet-like medium (20)

is discharged to each of said two or more medium exits (4A to 4F), and said control section controls, when the detection signal is received form said tray full sensor (15D) after the discharge detection signal is received from the discharge sensor for said lower side medium exit (4D), to stop the discharging of a sheet-like medium (20) from the lower side medium exit (4D) and urges to issue a tray full alarm, but controls, when the detection signal is received from said tray full sensor (15D) although no discharge detection signal is received from said discharge sensor for said lower side medium exit (4D), to stop the discharging of a sheet-like medium (20) from said lower side medium exit (4D) and discharge a sheet-like medium (20) from said upper side medium exit (4C).

19. The printing apparatus as set forth in claim 16, characterized in that said sensor element (17) is formed from an optical sensor which detects the other end side of said lever member (16) through a light intercepting movement of the other end side of said lever member (16).

20. The printing apparatus according to any one of claims 11 to 13, characterized in that the distance between said upper side tray (7C) and said lower side tray (7D) and the installation angle (θ) of each of said trays (7) are set so that, before a trailing end of a sheet-like medium (20) discharged from said upper side medium exit (4C) is released from discharge rollers (5, 5) at said upper side medium exit (4C), a leading end of the sheet-like medium (20) arrives at said lower side tray (7D).

21. The printing apparatus as set forth in claim 14, characterized in that, when said control section recognizes that, while it is detected by said detection section that said tray holder (8C) is in the second state, the length in the discharging direction of a sheet-like medium (20) designated as a printing object from the outside is shorter than the length of a discharge line for the sheet-like medium (20) from discharge rollers (5, 5) of said upper side medium exit (4C) to said lower side tray (7D), said control section controls to stop the discharging of a sheet-like medium (20) from said upper side medium exit (4C) and urges to issue an alarm.

* * * * *